US007172568B2

(12) United States Patent
Frangi

(10) Patent No.: US 7,172,568 B2
(45) Date of Patent: Feb. 6, 2007

(54) KNEE BAND FOR FRONT AND SIDE PROTECTION OF THE KNEE FROM IMPACTS

(75) Inventor: Giampietro Frangi, Varese (IT)

(73) Assignee: Pavis S.p.A. (IT)

( * ) Notice: Subject to any disclaimer, the term of this patent is extended or adjusted under 35 U.S.C. 154(b) by 204 days.

(21) Appl. No.: 10/478,461

(22) PCT Filed: Jun. 14, 2001

(86) PCT No.: PCT/IT01/00306

§ 371 (c)(1),
(2), (4) Date: Apr. 29, 2004

(87) PCT Pub. No.: WO02/102477

PCT Pub. Date: Dec. 27, 2002

(65) Prior Publication Data

US 2004/0199095 A1 Oct. 7, 2004

(51) Int. Cl.
*A61F 5/00* (2006.01)

(52) U.S. Cl. ..... 602/26; 602/23

(58) Field of Classification Search ..... 602/26, 602/12, 20, 23, 62–66
See application file for complete search history.

(56) References Cited

U.S. PATENT DOCUMENTS 5,399,153 A * 3/1995 Caprio, Jr. et al. ..... 602/26
5,727,252 A * 3/1998 Oetting et al. ..... 2/24
6,219,843 B1 4/2001 Passi et al.

FOREIGN PATENT DOCUMENTS

EP 0010389 4/1980
EP 0860153 8/1998

OTHER PUBLICATIONS

International Search Report.

* cited by examiner

*Primary Examiner*—Henry Bennett
*Assistant Examiner*—Shumaya B. Ali
(74) *Attorney, Agent, or Firm*—Connolly Bove Lodge & Hutz LLP

(57) ABSTRACT

A knee band is composed of a band of an elastic fabric (1), the whole external face (3) of which has a dense population of tiny loops of a suitable non elastic thread, interwoven with other elastic and non elastic threads that constitute the fabric, that extends perpendicularly to the surface such to provide for an anchor surface to the hooks of a Velcro® (i.e., fabric hook-and-loop) fastener portion (2*d*). The band is tightened essentially around the lower portion of the articulation of the knee, without being wrapped around the whole articulation. A preformed shell (5) shaped for adapting to and shielding the front and side portions of the knee is superimposed externally to the elastic band (1) and is fixed on the outer surface of the latter by means of Velcro® (i.e., fabric hook-and-loop) fasteners.

4 Claims, 3 Drawing Sheets

KNEE BAND FOR FRONT AND SIDE PROTECTION OF THE KNEE FROM IMPACTS

The present invention relates to protections that may be worn for protecting an articulation and more particularly to a knee band.

Several sports as well as other activities may expose the knees to violent strikes or impacts. Among sports, volleyball, skating, skate boarding imply a high risk of hitting on the knees when falling to the ground. Of course, even in many working activities the knees may be exposed to suffer from accidental hits.

In all these cases, the front and side portions of the knees are usually protected by suitably knee bands either stuffed or provided with inserts of an anti-shock material capable of absorbing the energy of hits and thus reducing traumatic effects on the knee.

Common tubular elastic knee bands are generally not adjustable and must be produced and sold in a series of relatively standardized different sizes, for obvious reasons of costs.

For obviating to those restrictions and drawbacks, WO 98/46175 describes elastic protections that may be tightened and adjusted and that use fastening devices of the well-known Velcro® type whose portions provided with hooks may be anchored in any position on the external face of the elastic fabric of the knee band by virtue of the fact that at least a third nonelastic textile thread is interwoven with other nonelastic and elastic threads and forms a dense population of tiny loops that extend perpendicularly to the external face of the fabric.

In any case all the known knee bands are elastically fitted around the knee covering both the lower and the upper portion of the articulation.

The natural conicity of the articulation makes the known elastic knee bands to slip down during prolonged physical activity. The user is forced to reset periodically its knee bands in the appropriate position, generally by pulling them up and straightening them.

On the other hand, in case of knee bands being worn only for protecting the front and side portions of the knee from violent shocks, they are generally burdensome to wear because to some extent they interfere with movements.

It is evident the need and/or the usefulness of a knee band for protecting the front and side portions of a knee from impacts that does not slip down during physical activity that may be tensioned in a perfectly adjustable manner and that does not interfere in any substantial extent with movements of the articulation.

The knee band of the present invention outstandingly satisfies all these needs.

Essentially the knee band of the present invention is composed of a band of an elastic fabric, the whole external face of which has, a dense population of tiny loops of a suitable non elastic thread, interwoven with other elastic and non elastic threads that constitute the fabric, that extends perpendicularly to the surface such to provide for an anchor surface to the hooks of a Velcro® fastener portion. The band is tightened essentially around the lower portion of the articulation of the knee, without being wrapped around the whole articulation.

A preformed shell shaped for adapting to and shielding the front and side portions of the knee is superimposed externally to the elastic band and is fixed on the outer surface of the latter by means of Velcro® fasteners.

The tightened elastic band fits around the lower portion of the articulation (around the upper end of the tibia), thus eliminating any tendency of the elastic band to slip down even during a prolonged physical activity, and ensuring a great liberty of movement of the articulation and greatly reducing discomfort.

A further advantage of the knee band of the invention is the possibility of substituting the external shell of anti-shock material, allowing an immediate substitution in case of wear and tear or damage, and even the possibility of changing shells of different sizes, shapes, and/or shock absorption characteristics because of changed conditions of use of the knee band.

The novel knee band of the invention is more precisely defined in the annexed claim 1, and particularly preferred embodiments are defined in dependent claims.

Figure 1:
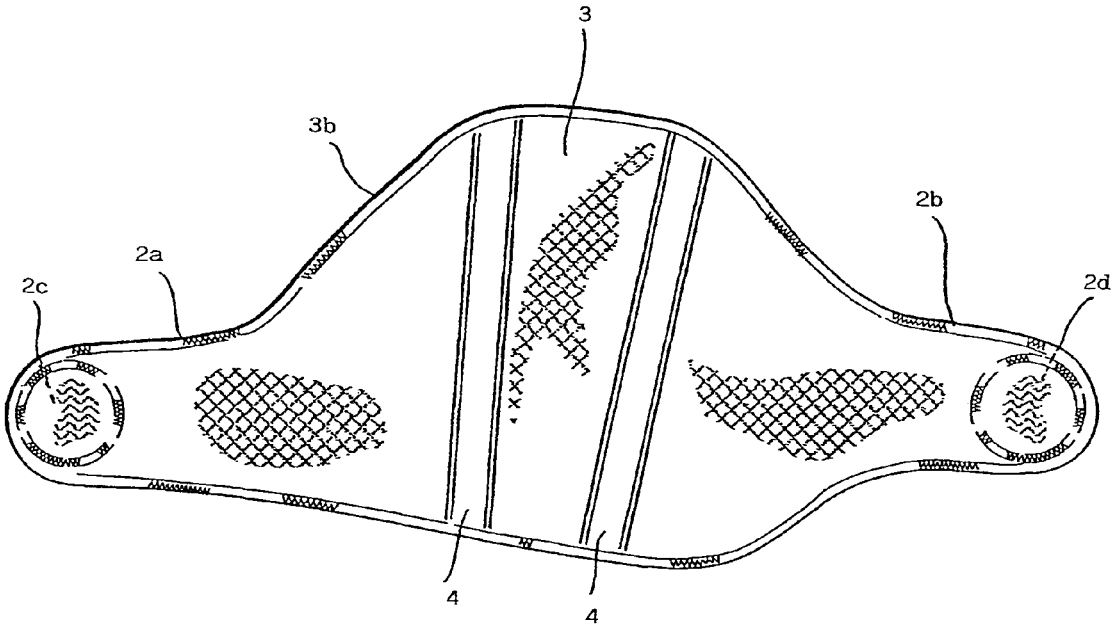
FIG. 1 is a plan view of the unfolded elastic band of the knee band of the invention.

Referring to FIG. 1, the band of elastic fabric 1 of the knee band is depicted in an unfolded flat position. The band is made of an elastic fabric comprising at least a thread, preferably a single strand, of nylon, polyester, Mylar® (i.e., polyester film) or similar, interwoven with threads of elastomer and other textile threads in a way to form a dense population of tiny loops of said single strand of nylon, polyester, Mylar® (i.e., polyester film) or similar extending from the outer surface of the fabric for a certain height (from 0.5 to 2 millimeters) in a direction perpendicular to the surface.

For example, a fabric that may be appropriately used in this case is described in the International patent application WO 98/46175, in the name of the same applicant. Of course, other functionally equivalent fabrics may be used, the essential requirement being the presence of said dense population of loops suitable for providing anchoring of portions with hooks of Velcro® (i.e., fabric hook-and-loop) fasteners in any position on the outer face of the band 1.

As it may be noticed from the cited figure, the band of elastic fabric 1 has a central portion whose height may be generally comprised between 14 and 20 centimeters while the height of the elastic fabric progressively reduces to form two lateral wings or arms 2*a* and 2*b* whose mean height is generally comprised between 4 and 7 centimeters.

An essential feature is that the two lateral arms 2*a* and 2*b* are at different levels. In particular, while the lateral wing or arm 2*a* extends from the base of the central portion 3, the lateral wing or arm 2*b* extends from a higher level in order to allow for the free ends of the two wings 2*a* and 2*b* to cross substantially without interfering with one another, as it will be better illustrated hereinbelow.

On the inner face of the article, at the end of the two lateral wings or arms 2*a* and 2*b*, there are portions with hooks 2*c* and 2*d* of as many Velcro® fasteners.

Optionally, as illustrated in the example, in the central portion 3 of the band of elastic fabric 1 there may be two stiffeners 4 of an appropriate elastic material, for example a flattened wire spiral, commonly inserted in a permanent manner in tubular pockets of the textile article.

The function of these stiffeners is to keep extended the central portion 3 of the elastic band by preventing the formation of creases or folds when wearing the knee band.

As depicted in FIG. 1, the stiffeners 4 are preferably divergent from one another from the lower edge to the upper edge of the elastic band such to define a central area fitting over the front portion of the knee.

Though being made of elastic textile material and having a certain thickness, the elastic band 1 does not incorporate a preformed cushion or a stuffing of an anti-shock material.

Figure 2:
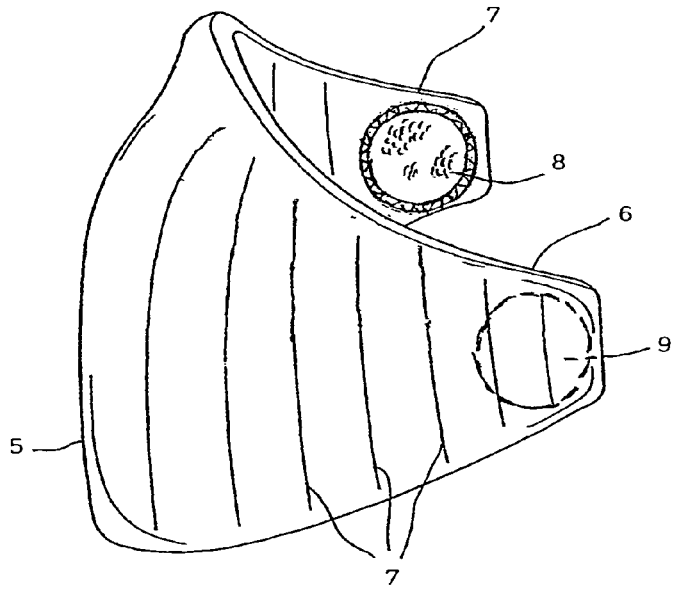
FIG. 2 is a perspective view of the superimposable external shell of the knee band of the invention.

Protection from impacts and hits is provided accomplished by the outer shell 5 depicted in the perspective view of FIG. 2.

The shell 5 is shaped for covering anatomically the knee-cap or more precisely the front and side portion of the knee articulation. The shell may consist of a body of an anti-shock material, for example a molded high density expanded resin, or be made in a composite form by coupling between them layers of different materials.

The shell 5 retains a certain flexibility even if it is preformed by molding, and may be easily opened wide by flexing apart its lateral wings or arms 6 and 7 for setting it in place and attaching it onto the underlying elastic band that had been previously wrapped and tightened around the lower portion of the articulation (upper extremity of the tibia).

For enhancing such a flexibility, the shell 5 may be molded with a series of depressions or valleys 5*i* generally vertically oriented for increasing flexibility.

The profile of the lower edge of the shell 5 is substantially linear while its upper edge has a profile that is salient at the middle.

On the inner surface of the shell 5 and near the extremities of the two wings or lateral arms 6 and 7 there are portions with hooks, respectively 8 and 9, of Velcro® fasteners.

Optionally one or more hooked portions of Velcro® fasteners may also be present on other portions on the inner surface of the shell 5, for example a strip of hooked Velcro® portion may be present near the lower edge of the shell for enhancing the stability of its mechanical anchoring on the elastic band.

Figure 3:
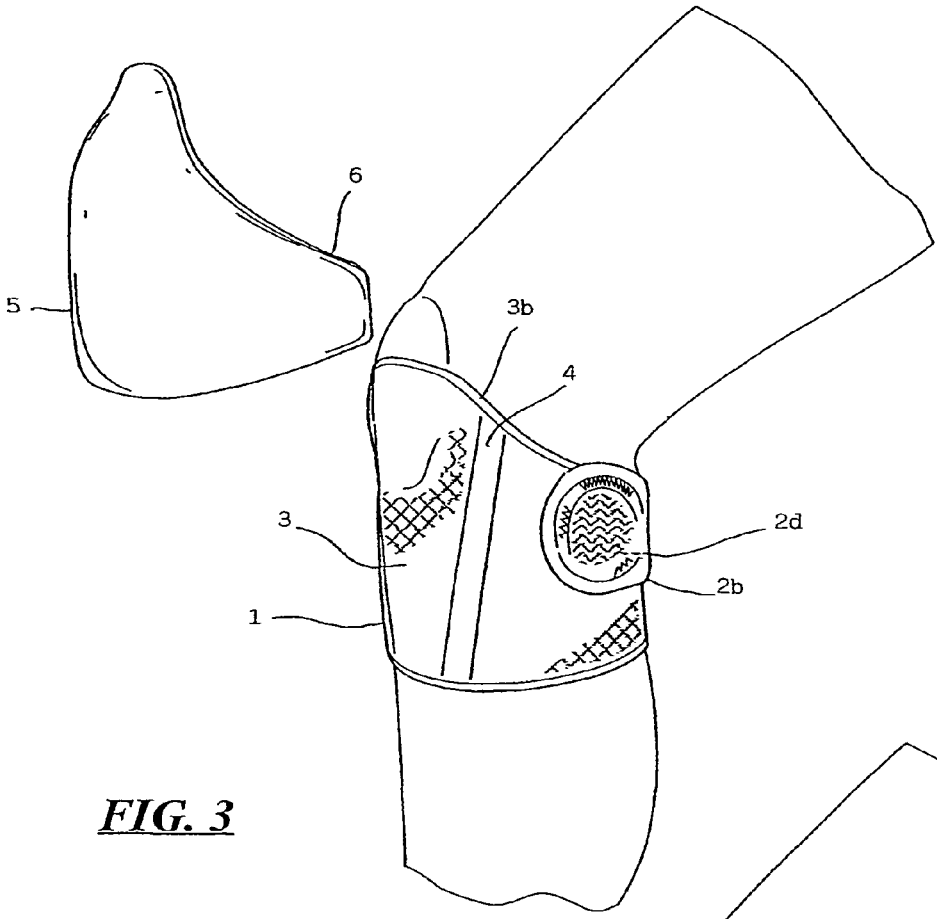
FIGS. 3 and 4 depict a knee band of the invention applied on the articulation.
Figure 4:
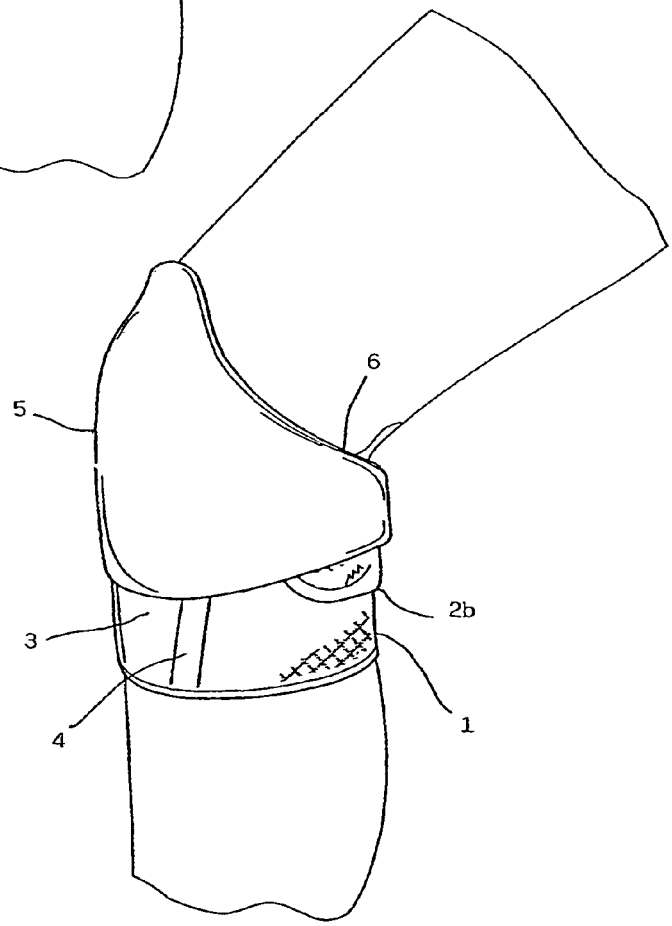

FIGS. 3 and 4 show how to wear the anti-shock knee band of the invention.

The upper edge of the central portion of the elastic band 1 tightened substantially around the lower portion of the articulation, because of its salient profile, covers at least partially the lower portion of the knee-cap.

The shell 5 is simply positioned on the outer textile surface of the band 1 of elastic fabric, having a dense population of tiny loops of a single strand thread as described above, in a position appropriate to protect the front and side portions of the articulation and when properly set, the two lateral wings or arms 6 or 7 are released and eventually pressed on the underlying elastic band 1 thus anchoring firmly the portions 8 and 9 provided with hooks, present on the inner faces of the two lateral wings or arms 6 and 7 of the shell 5.

As it may be noticed in FIG. 4, the salient profile of the upper edge of the shell 5 determines a suitable shielding, of the upper front portion of the knee notwithstanding the fact that the composite knee band leaves the fullest liberty of movement to the articulation.

Figure 5:
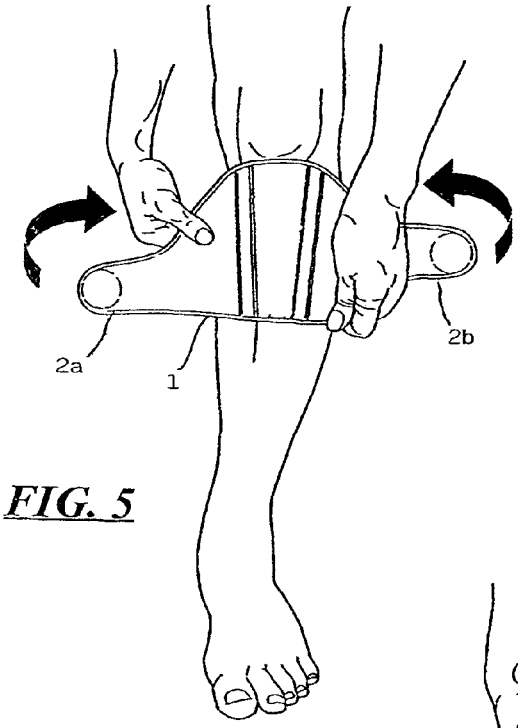
FIGS. 5, 6 and 7 show various steps of the fitting of the knee band on the articulation.
Figure 6:
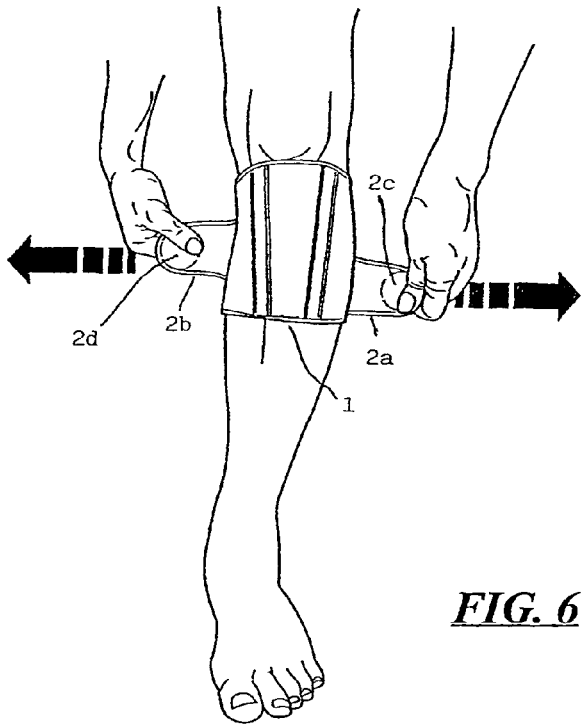
Figure 7:
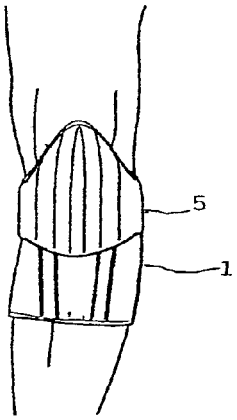

FIGS. 5, 6 and 7 illustrate in an intuitive manner how to wear the knee band of the invention.

As it may be easily noticed from FIGS. 6 and 7, the fact that the elastic band 1 is tightened around the upper end portion of the calf, without wrapping around the articulation nor around the lower end portion of the thigh, as is normally the case with the known knee bands, overcomes completely the tendency of those implements to shift during a prolonged dynamic activity.

The knee is free to bend without continuously folding and tensioning the knee band, though being properly protected by the shell 5.

The invention claimed is:

1. A knee band for protecting front and side portions of a knee from impacts, said knee band comprising:

a band of elastic fabric comprising elastomer threads, first and second nonelastic textile threads and at least a third nonelastic textile thread of a material selected from the group consisting of nylon, polyester and polyester film, said third nonelastic textile thread being interwoven with said elastomer thread and said first and second nonelastic textile threads so as to form a dense population of loops rising to a certain height in a direction normal to an outer surface of the elastic fabric;

at least two hooked portions having hooks of two respective fabric hook-and-loop fastening devices, said at least two hooked portions being located on an inner surface near an end of opposite wings of said band of elastic fabric and being superimposed and anchored in a portion on said outer surface of said elastic fabric upon wrapping and tightening said elastic band around a limb, wherein:

said opposite wings are arranged to be anchored on any portion of said outer surface of said elastic fabric;

said opposite wings narrow and extend themselves at different levels with respect to a height of a central portion of said band of elastic fabric, thereby crossing themselves without interfering with one another and superimposing on said outer surface of said elastic fabric upon tightening the elastic band around an upper end portion of the calf; and an upper edge of said central portion has a salient profile with respect to said different levels; and a shell of anti-shock material superimposed on said elastic band, said shell of anti-shock material being shaped to shield said front and side portions of the knee and having two lateral wings, wherein an inner surface of said two lateral wings has portions with hooks of respective fabric hook-and-loop fastening devices anchored on said outer surface of said elastic fabric.

2. The knee band according to claim 1, wherein the central portion of said band has at least two anti-crease stiffeners diverging from the lower edge to the upper edge, wherein the upper edge has a salient profile of the central portion of the band.

3. The knee band according to claim 1, wherein a central portion of the upper edge of said shell has a salient profile to fully shield the front and side portions of the knee.

4. The knee band according to claim 1, wherein said shell has at least a third portion with hooks of a third fabric hook-and-loop fastening device on its inner surface near the lower edge of the central portion of the shell.

* * * * *